United States Patent [19]

Metler

[11] 4,396,191

[45] Aug. 2, 1983

[54] ADJUSTABLE INCLINE WEIGHT LIFTER BENCH

[75] Inventor: Keith R. Metler, Wheeling, Ill.

[73] Assignee: KRM Inc., Highwood, Ill.

[21] Appl. No.: 279,344

[22] Filed: Jul. 1, 1981

[51] Int. Cl.[3] ..... A63B 23/00

[52] U.S. Cl. ..... 272/123; 172/144

[58] Field of Search ..... 272/122, 123, 117, 144, 272/145, 118, 134

[56] References Cited

U.S. PATENT DOCUMENTS

| | | | |
|---|---|---|---|
| 3,948,513 | 4/1976 | Pfotenhauer | 272/134 |
| 4,098,502 | 7/1978 | Faust | 272/122 |
| 4,286,782 | 9/1981 | Fuhrhop | 272/123 |

FOREIGN PATENT DOCUMENTS

| | | | |
|---|---|---|---|
| 2065482 | 7/1981 | United Kingdom | 272/122 |

*Primary Examiner*—Richard J. Johnson

*Attorney, Agent, or Firm*—Wood, Dalton, Phillips, Mason & Rowe

[57] ABSTRACT

An adjustable incline weight lifter bench having a support pad connected to the barbell support to provide automatic angular adjustment of a portion of the pad as a function of the disposition of the barbell support in any one of a plurality of vertically spaced positions. The bench includes a base defining a guide for guiding the pad to the selected disposition thereon. The pad may include a buttocks-supporting portion movably connected to the back-supporting portion connected to the barbell support for automatic positioning of the entire pad on the base. The bench is arranged so that the back-supporting portion of the pad disposes the user substantially below the barbell support in all adjusted positions thereof for improved facilitated weight lifting exercises.

16 Claims, 4 Drawing Figures

ADJUSTABLE INCLINE WEIGHT LIFTER BENCH

BACKGROUND OF THE INVENTION

1. Field of the Invention

This invention relates to weight lifting benches and in particular to incline weight lifting benches.

2. Description of the Prior Art

One excellent form of body building exercise is weight lifting. In one form of such weight lifting exercise, the person lies prone on a bench with the barbell weights supported above him on suitable rests, or supports. The user then reaches up and lifts the barbell weight from the support while his body is maintained in the supine position.

In one improved form of weight lifting bench, a portion of the body support pad is pivotally mounted on the base so as to be adjustabely rearwardly upwardly inclined, thereby supporting the user's back at any one of a plurality of different inclined positions. An excellent example of such an inclined bench is illustrated in the publication of the inventor hereof dated Apr. 16, 1981, as a Model 111 incline bench. As disclosed in that publication, the bench includes a dual frame structure wherein the incline assembly is provided with a separate frame, permitting the incline assembly to have any one of five different positions of inclination. The bench is further characterized as having an anti-tip plate.

As shown in the publication, the barbell weight support is carried at the top of a rear upright structure of the incline bench. As can be seen from the publication, the disposition of the barbell weight on the supports becomes progressively spaced rearwardly of the back support portion of the bench pad as the back support portion is inclined more and more upwardly. In the uppermost position, as shown in the publication, the barbell support is spaced substantially rearwardly of the person supported on the pad.

Another problem with prior art incline benches is the limitation on the amount of inclination obtainable. Such benches conventionally have a maximum inclination of approximately 60°.

SUMMARY OF THE INVENTION

The present invention comprehends an improved incline bench for use in weight lifting exercising wherein the body support pad is arranged to have a rear portion thereof disposed substantially vertically below the weight lifting supports of the rear upright support means of the bench at all times to provide an improved safe weight lifting device.

The incline bench structure of the present invention includes means for automatically angularly positioning the pad means of the bench as a function of the vertical positioning of the weights carried on the rear support means of the bench.

More specifically, the invention comprehends an improved incline bench including a base defining an upper support, support means at a rear end of the base and including a portion extending upwardly therefrom, carrier means vertically adjustably positionable on the upright support means for removably supporting a barbell, body-supporting means movably carried on the base support including a buttocks-supporting portion, and a back-supporting portion having a rear portion adjacent the rear end of the base, and a front portion forwardly adjacent the buttocks-supporting portion, means for causing the back-supporting portion to be angled rearwardly upwardly from the base support as an incident of the carrier means being positioned upwardly on the support means, the rear portion of the body supporting means back-supporting portion being disposed substantially vertically below the barbell supporting carrier means in all vertically adjusted positions of the carrier means for facilitating weight lifting exercising with a barbell removably supported thereon by a person carried on the body supporting means.

In the illustrated embodiment, the bench structure includes means for connecting the back-supporting rear portion of the pad means to the carrier means to have the pad horizontally arranged with the portions thereof in end-to-end relationship when the carrier means is disposed in a lowermost position.

The connecting means between the pad portions and the carrier means is arranged to cause the back-supporting portion to be substantially vertically arranged in the uppermost position of the carrier. Thus, the pad means is arranged to be automatically disposed over a wide range of angular positions directly corresponding to the positioning of the weight on the upright support of the bench.

The improved inclined bench structure of the present invention is extremely simple and economical, while yet providing an improved, safe weight lifting arrangement.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
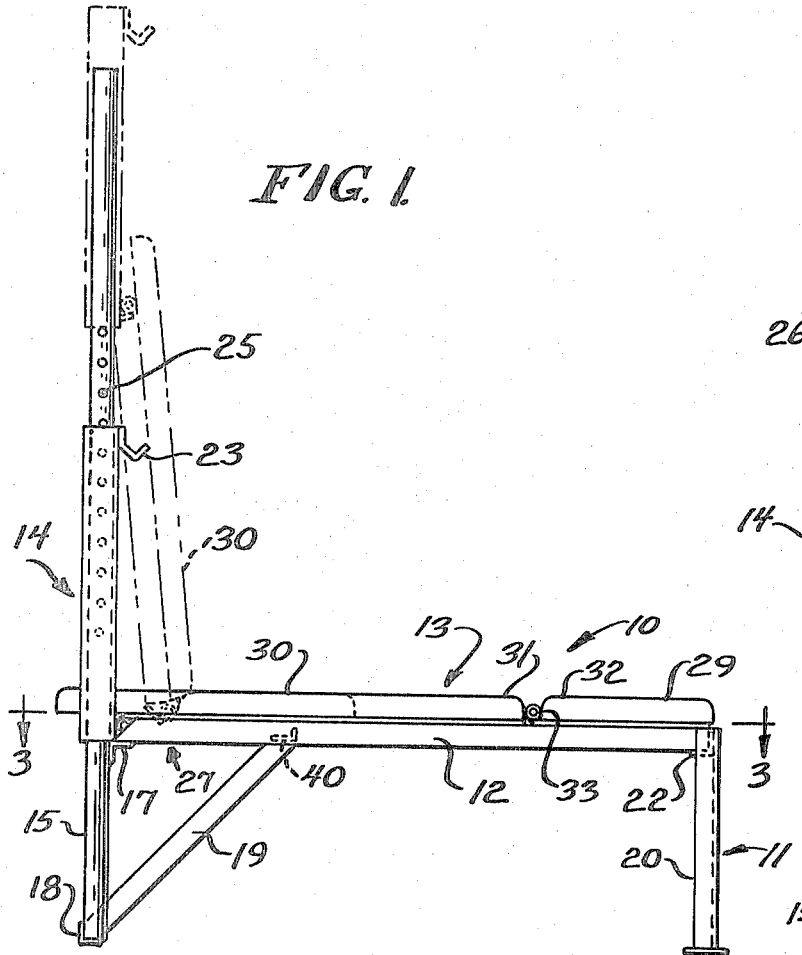
FIG. 1 is a side elevation of an incline bench embodying the invention, with the body-supporting pad shown in a fully inclined position in broken lines.

In the exemplary embodiment of the invention as disclosed in the drawing, an incline bench generally designated 10 is shown to include structural frame base generally designated 11 defining an upper support 12. Support 12 defines a guide for movably carrying a body support pad generally designated 13.

As further shown, the bench includes a rear, upright support generally designated 14. As seen in FIG. 2, the support is defined by a pair of upright posts 15 and 16 secured to the rear of the base portion 12 by a cross brace 17. The lower ends of the posts 15 and 16 are stabilized by a second cross brace 18 and, as shown in FIG. 2, the posts are spaced apart a distance greater than the width of the bench base 11 by the cross braces 17 and 18. As further shown in FIGS. 1 and 4, the support 14 is further rigidified by means of angle braces 19 extending upwardly from lower cross brace 18 to the base support 12.

As further shown, the front end of the base 11 is defined by a pair of short vertical legs 20 carried on a cross plate 21. The upper ends of the legs 20 are rigidified by a cross brace 22.

As shown, the base is formed primarily of structural angles and may be secured in assembled relationship as by suitable welding.

The bench further includes means for removably supporting a weight, such as a barbell weight, in the form of a pair of rests, or supports, 23 carried one each on a pair of sleeves 24, in turn carried slidably one each on the posts 15 and 16, respectively.

The posts are provided with a plurality of vertically spaced through openings 25 adapted to receive a support pin 26 for supporting the sleeves 24 in any one of a plurality of vertically spaced selected positions to correspondingly support the weight rests 23 in any one of a plurality of vertically spaced positions. In effecting such retention of the sleeves 24, the user merely slidably adjusts the position of the sleeves on the posts and then inserts the support pins 26 through the openings exposed immediately below the bottom of the sleeves in the adjusted position.

Figure 2:
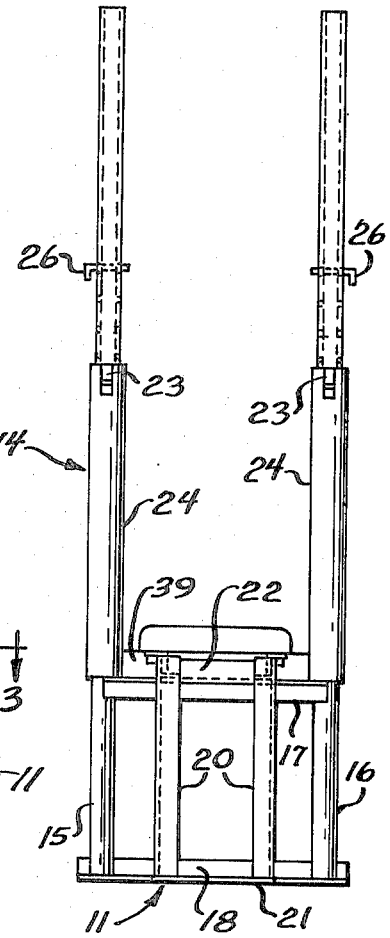
FIG. 2 is a front elevation thereof.
Figure 3:
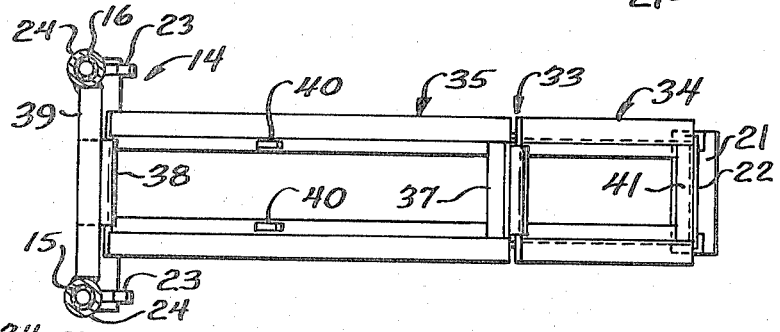
FIG. 3 is a horizontal section taken substantially along the line 3—3 of FIG. 1.

As shown in FIG. 1, the weight rests extend forwardly from the upper end of the sleeves so as to dispose a barbell weight resting thereon generally in spaced overlying relationship to the rear portion generally designated 27 of the base.

Pad 13 includes a buttocks-supporting portion 29 and a back-supporting portion 30 having an overall length substantially equal to that of the base portion 12, as seen in FIG. 1. The forward end 31 of the back-supporting portion is pivotally connected to the rear end 32 of the buttocks-supporting portion 29 by a suitable pivot connector 33.

Figure 4:
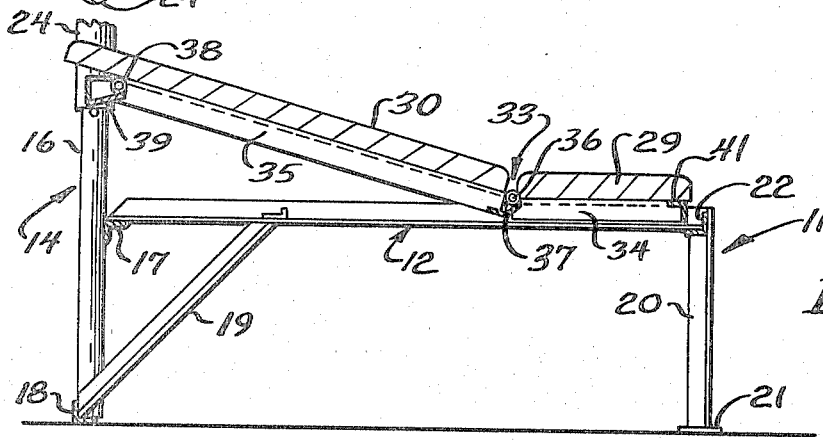
FIG. 4 is a fragmentary vertical section taken along the fore-and-aft center of the bench and illustrating the arrangement of the body-supporting pad means in a partially inclined disposition.

More specifically, as seen in FIG. 4, the buttocks-supporting pad 29 includes a lower frame 34 and the back-supporting portion 30 includes a lower frame 35. A pivot pin 36 is connected to a pin carrier 37 to define the pivot connection between frames 34 and 35.

The rear end of frame 35 is provided with a similar pivot pin 38, which is pivotally connected to a pin carrier 39 secured between the sleeves 24 at the lower end thereof for pivotally connecting the rear end of frame 35 to the sleeves, whereby the pad structure 13 is selectively positioned in the lowermost horizontal position of FIG. 1 when the sleeves 24 are in their lowermost position, and in gradually increasing inclined dispositions, as illustrated in full lines in FIG. 4 and broken lines in FIG. 1, as the sleeves are selectively raised to different vertically upwardly spaced positions corresponding thereto.

As seen in FIG. 1, in the maximum uppermost position of the sleeves, the back-supporting portion 30 of the pad 13 is disposed substantially vertically in an almost 90° upright relationship to the horizontal position illustrated in full lines. Thus, the back-supporting portion 30 of the pad may be selectively positioned in any one of a plurality of different angular positions corresponding to the vertical spacing of the openings 25 in the support posts 15 and 16 as desired by the user.

The angular positioning of the back-supporting portion 30 is automatically effected as an incident of the raising of the upright support sleeves 24 and because of the pivotal connection of the pad portion 30 to the pad portion 29, the pad portion 29 is automatically correspondingly repositioned, as illustrated in FIG. 4.

As can be best seen in FIG. 1, the rear portion of the back-supporting portion 30 of the pad 13 is disposed substantially at all times subjacent the weight rests 23 so that the user of the bench lying on the pad 13 has the barbell weights disposed generally in the same vertical relationship to his body over the range of angular positions of the back-supporting portion 30. Thus, the present bench construction provides an improved facilitated weight lifting exercise over the entire range of angular positioning of the user on the pad 13. Thus, the incline bench of the present invention provides an improved, safe weight lifting exercise bench which is extremely simple and economical of construction while yet providing the highly desirable features discussed above.

As shown, seat stops 40 may be provided on the upper support angles 12 for engagement by an angle flange 41 on frame 34 when the back support 30 is brought fully to the upright position, thereby acting as safety stop means for limiting rearward movement of the pad means to a maximum perpendicular arrangement of the back and buttock support portions of pad 13.

The foregoing disclosure of specific embodiments is illustrative of the broad inventive conceptw comprehended by the invention.

I claim:

1. An incline bench for use in weight lifting exercising, said bench comprising:

a base defining an upper support;

support means at a rear end of the base and including a portion extending upwardly therefrom;

carrier means vertically adjustably positionable on said upright support means for removably supporting a barbell;

body supporting means translatably carried on said base support including a buttocks-supporting portion, and a back-supporting portion having a rear portion adjacent said rear end of the base, and a front portion forwardly adjacent said buttocks-supporting portion; and means for causing said back-supporting portion to be angled rearwardly upwardly from said base support as an incident of said carrier means being positioned upwardly on said support means, said rear portion of the body supporting means back-supporting portion being substantially similarly spaced substantially vertically below the barbell supporting carrier means in all vertically adjusted positions of said carrier means for facilitating weight lifting exercising with a barbell removably supported thereon by a person carried on said body supporting means.

2. The incline bench structure of claim 1 including means connecting said front portion of said body supporting means back-supporting portion to said buttocks-supporting portion thereof whereby said buttocks-supporting portion is maintained adjacent said front portion on said upper support in all adjusted positions of said back-supporting portion.

3. The incline bench structure of claim 1 including pivot means pivotally connecting said front portion of said body supporting means back-supporting portion to said buttocks-supporting portion thereof whereby said buttocks-supporting portion is maintained adjacent said front portion on said upper support in all adjusted positions of said back-supporting portion.

4. The incline bench structure of claim 1 wherein said carrier means comprises means slidably mounted to said support means.

5. The incline bench structure of claim 1 wherein said support means comprises vertical post means and said carrier means comprise tubular sleeve means slidably fitted about said post means.

6. The incline bench structure of claim 1 including means for retaining said carrier means on said support means in any one of a plurality of vertically spaced discrete positions.

7. The incline bench structure of claim 1 wherein cooperating means are provided on the base and body supporting means for limiting the angle between said back-supporting portion and buttocks-supporting portion to 90°.

8. An incline bench for use in weight lifting exercising, said bench comprising:

a base defining upper guide means;

upright support means at a rear end of the base and including a portion projecting upwardly from the level of said upper guide means;

carrier means vertically adjustably positionable on said upright support means for removably supporting a barbell;

pad means translatably carried on said guide means including a buttocks-supporting portion, and a back-supporting portion having a rear portion adjacent said rear end of the base and a front portion adjacent said buttocks-supporting portion; and means for connecting said rear portion of said pad means back-supporting portion to said carrier means to have said supporting portions horizontally aligned end-to-end when said carrier means is disposed in a low position and to cause said back-supporting portion to be angled rearwardly upwardly from the guide means as an incident of said carrier means being positioned upwardly of said low position, said rear portion of the pad means back-supporting portion being substantially similarly spaced substantially vertically below the barbell supporting carrier means in all vertically adjusted positions of said carrier means for facilitating weight lifting exercising with a barbell removably supported thereon by a person carried on said pad means.

9. The incline bench structure of claim 8 wherein said means for connecting said rear portion of said pad means back-supporting portion to said carrier means comprises pivot means.

10. The incline bench structure of claim 8 wherein said upright support means includes a pair of posts one each at opposite sides of said rear portion of said pad means back-supporting portion.

11. The incline bench structure of claim 8 wherein said upright support means includes a pair of posts one each at opposite sides of said rear portion of said pad means back-supporting portion and said carrier means comprises tubular sleeves slidably carried one each on said posts.

12. The incline bench structure of claim 8 wherein said upright support means includes a pair of posts one each at opposite sides of said rear portion of said pad means back-supporting portion and said carrier means comprises tubular sleeves slidably carried one each on said posts and provided with forwardly projecting barbell support means.

13. The incline bench structure of claim 8 wherein said upright support means includes a pair of posts one each at opposite sides of said rear portion of said pad means back-supporting portion and said carrier means comprises tubular sleeves slidably carried one each on said posts, and said means for connecting said rear portion of said pad means back-supporting portion to said carrier means comprises connecting means at the lower end of said sleeves.

14. The incline bench structure of claim 8 wherein the range of angular adjustment of said back-supporting portion is approximately 90°.

15. The incline bench structure of claim 8 wherein cooperating means are provided on the base and pad means for limiting the angle between said back-supporting portion and buttocks-supporting portion to 90°.

16. The incline bench structure of claims 1 or 8 wherein cooperating means are provided on the upper support of the base and said buttocks-supporting portion for limiting the angle between said back-supporting portion and buttocks-supporting portion to 90°.

* * * * *